US005361703A

United States Patent [19]

Braithwaite

[11] Patent Number: 5,361,703

[45] Date of Patent: Nov. 8, 1994

[54] INERT THERMALLY ACTIVATED BURSTER

[75] Inventor: Moyle L. Braithwaite, Ridgecrest, Calif.

[73] Assignee: The United States of America as represented by the Secretary of the Navy, Washington, D.C.

[21] Appl. No.: 888,082

[22] Filed: May 26, 1992

[51] Int. Cl.[5] ..... F42B 41/00

[52] U.S. Cl. ..... 102/481; 60/253

[58] Field of Search ..... 102/481, 374, 381, 293; 60/253, 255

[56] References Cited

U.S. PATENT DOCUMENTS

| | | | |
|---|---|---|---|
| 3,052,091 | 9/1962 | D'Ooge | 102/374 |
| 4,442,666 | 4/1984 | Vetter | 60/253 |
| 4,458,482 | 7/1984 | Vetter et al. | 60/253 |
| 4,478,151 | 10/1984 | Vetter et al. | 102/481 |
| 4,494,373 | 1/1985 | Vetter et al. | 60/253 |
| 5,035,180 | 7/1991 | Purcell et al. | 102/481 |
| 5,035,182 | 7/1991 | Purcell et al. | 102/481 |
| 5,129,326 | 7/1992 | Brogan | 102/481 |

*Primary Examiner*—David Brown

*Attorney, Agent, or Firm*—Stephen J. Church; Melvin J. Sliwka; John L. Forrest, Jr.

[57] ABSTRACT

A burster for rupturing a casing containing an active explosive or propellant material of an ordnance device to prevent cook-off has an inert and thermally expansible material in an enclosure defined by a wall fixed to the casing so that thermal expansion of the inert material exerts on the wall a force to rupture the casing and vent the active material. The wall may have a stress riser groove to promote rupture at a predetermined location on the casing, and the volume of the inert material at ambient temperature may be less than the volume of the enclosure so that rupturing force is not exerted until a selected venting temperature is approached.

9 Claims, 2 Drawing Sheets

INERT THERMALLY ACTIVATED BURSTER

BACKGROUND OF THE INVENTION

1. Field of the Invention

This invention pertains to ammunition, explosive devices, and reaction motor power plants having a casing opened by a safety device when the casing is externally heated so that propellant or explosive within the casing is vented so as to burn rather than deflagrate or detonate.

2. Description of the Prior Art

Ordnance items present an extreme hazard in the event of "cook-off" which may be defined as the detonation or deflagration of an active material, such as an explosive or a propellant charge, due to external heating in an accidental fire or the like. This hazard is, typically, minimized by providing a casing, which contains the charge, with an arrangement for opening the casing to vent pressure therein before the casing attains a temperature where cook-off may occur. Such a casing contributing to cook-off may be a wall, as of a rocket motor or penetrating warhead, directly in contact with the active material, but may include structure surrounding the motor or warhead.

Prior art cook-off prevention arrangements include rocket motor casings of reinforced plastic which soften and fail on fast, direct cook-off from exposure to flame before a contained propellant attains cook-off temperature. However, this arrangement is ineffective when the casing is subjected to slow cook-off from indirect heating. Another arrangement utilizes a casing with stress riser grooves which cause the casing to open thereat when the casing is subjected to pressure by an explosive therein initially decomposing from heat. This arrangement is effective with relatively weak casings on both fast, direct cook-off and slow, indirect cook-off. However, with a relatively strong casing for target penetration the stress risers cannot weaken the case sufficiently so that venting either does not occur to prevent cook-off or occurs at such a high pressure that nearby structures are damaged and personnel are injured.

Prior art cook-off prevention arrangements also include a casing provided with an orifice having a closure opened or released by melting or thermal stress. Other prior-art arrangements include a casing vented by thermal stress when one side is heated. This stress may be increase by stiffening and thermally insulating portions of the casing. These arrangements, like the stress riser arrangement, are deficient with strong casings. Further prior art arrangements include explosive or other casing penetrators activated at a temperature approaching cook-off. These latter arrangements are effective but may themselves be a hazard and require initiation devices which are relatively complex and may be adversely affected by long storage.

SUMMARY AND OBJECTS OF THE INVENTION

A burster for rupturing a casing containing an active explosive or propellant material of an rocket motor, warhead, or the like to prevent cook-off has an inert and thermally expansible material in an enclosure defined by a wall fixed to the casing so that thermal expansion of the inert material exerts on the wall a force to rupture the casing and vent the active material. The wall may have a stress riser groove to promote rupture at a predetermined location on the casing, and the volume of the inert material at ambient temperature may be less than the volume of the enclosure so that rupturing force is not exerted until a selected venting temperature is approached.

It is an object of the present invention to provide, for the casing of an ordnance item, a burster for opening the casing to prevent cook-off.

Another object is to provide such a burster which is effective with a casing of relatively strong construction to protect such a casing against cook-off from both fast, direct heating and slow, indirect heating.

Still another object is to provide such a burster which uses inert materials and which may be constructed to operate dependably at a selected temperature.

Yet another object is to provide such a burster adaptable to a variety of ordnance items including rocket motors, penetrating warheads, and structures containing such motors and warheads.

Further objects are to provide such a burster which is compact, rugged, light in weight, simple in construction, adaptable to a variety of ordnance items, not affected by storage, and fully effective to vent an ordnance item before cook-off can occur.

BRIEF DESCRIPTION OF THE DRAWINGS

Other objects, advantages, and novel features of the present invention will be apparent from the following detailed description when considered with the accompanying drawings wherein.

DETAILED DESCRIPTION

Figure 1:
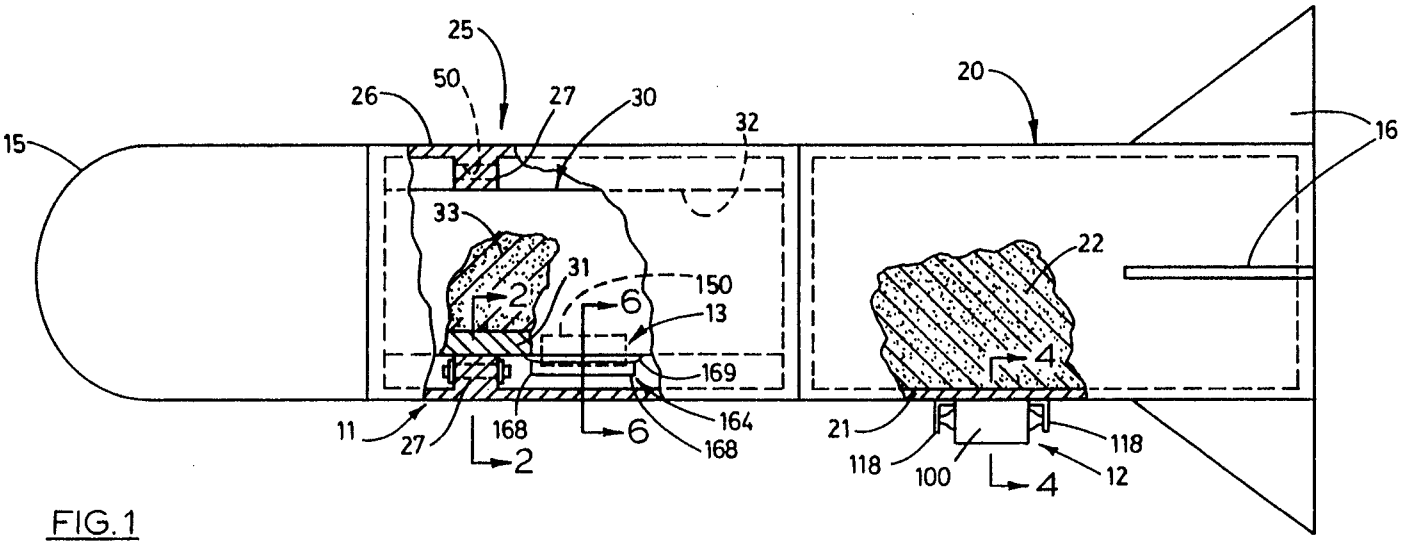
FIG. 1 is a schematic elevation of a missile which illustrates a representative operating environment for three embodiments of the present invention and which has portions broken away to show the interior.

FIG. 1 shows a missile or ordnance device provided with a first inert thermally activated burster 11, a second inert thermally activated burster 12, and a third inert thermally activated burster 13 which are, respectively, a first, a second, and a third embodiment of the present invention. The missile, which is schematically represented and has a nose portion 15 and fins 16 not involved in the present invention, is to be understood as being generally cylindrical and as typifying ordnance devices generally as operating environments for the present invention.

The after portion of the missile is a rocket motor 20 having a skin or cylindrical casing 21 broken away to show an active propellant material 22 contained therein. Material 22 is subject to cook-off when heated to a predetermined cook-off temperature when the missile is exteriorly heated as by an accidental fire. Casing 21 mounts burster 12 in a manner subsequently described.

The missile has a warhead portion 25 extending between its portions 15 and 20 and having an exterior skin or cylindrical casing 26 including an interior, unitary, circumferential rib 27 which receives burster 11 in a manner subsequently described.

Warhead portion 25 has a penetrating warhead 30 disposed centrally therein and closely received in rib 27 which structurally supports the warhead. Warhead 30 has a relatively strong cylindrical casing 31 which is broken away to show an cavity 32 filled with an active explosive material 33 which is subject to cook-off at a predetermined cook-off temperature. Casing 31 incorporates burster 13 as subsequently described. It is apparent that rib 27 and casing 31 both constrain material 33 so that both contribute to the cook-off hazard thereof.

The respective positions of bursters 11, 12, and 13 in relation to rib 27, casing 21, and casing 31 in the present Figures and the relation of the rib and casing elements to the depicted ordnance device are for illustrative purposes only and are not a portion of the present invention. Other arrangements that embody but do not limit the present invention may include casings similar to casings 21 or 31 incorporating a burster of the present invention in a rib such as rib 27; may involve such a rib which is external or longitudinal rather than circumferential and internal like rib 27; may involve a warhead casing similar to casing 31 but exteriorly disposed or not associated with a rocket motor; may include bursters similar to either burster 12 or 13 disposed interiorly of a casing or in a rib similarly to burster 11; and may have a burster similar to burster 11, but disposed directly in a casing similar to casings 21 or 31.

FIRST EMBODIMENT

Figure 3:
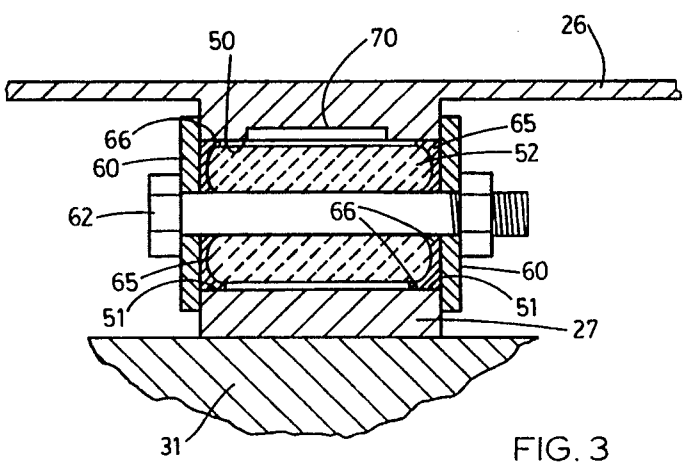
FIG. 3 is an axial section of the first embodiment from the position of line 3—3 of FIG. 2.
Figure 2:
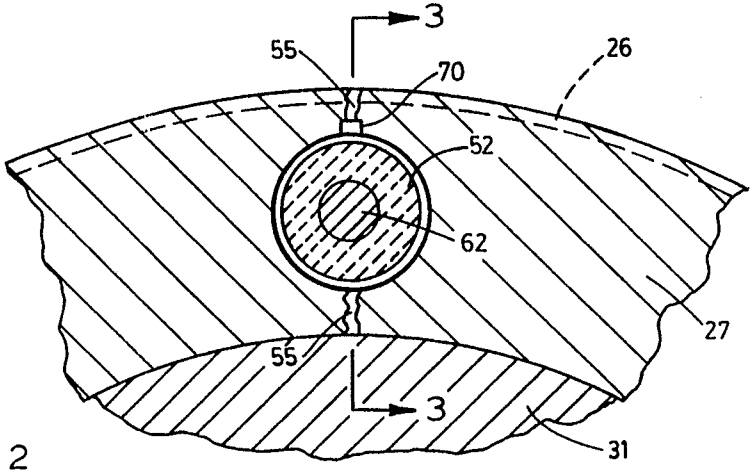
FIG. 2 is a diametrical section of a first embodiment of the invention from the position of line 2—2 of FIG. 1 and at an enlarged scale.

Burster 11, as shown in greater detail in FIGS. 2 and 3, is received in a bore 50, such as a preexisting lightening hole in rib 27, having opposite open ends. As a result, the portion of this rib immediately outwardly and circumferentially of bore 50 is a wall defining an enclosure for a quantity 52 of any suitable inert and thermally expansible material for rupturing the enclosure in accordance with the present invention. Material 52 and the volume thereof are selected so that, at ambient temperatures to which an ordnance device provided with burster 11 is subjected in normal operation, this material exerts on rib 27 a force insufficient to structurally affect the rib. However, as material 52 tends to expand as its temperature increases from such an ambient temperature toward a substantially higher predetermined cook-off temperature of explosive 33, material 52 exerts on the rib a force which increases with temperature until, when the inert material is at a predetermined venting temperature between such an ambient temperature and the cook-off temperature, this force is sufficient to rupture the rib. Such a rupture typically occurs in a region extending diametrically oppositely from bore 50 and indicated by irregular lines 55. It is apparent that rupture 55 of rib 27 also ruptures casing 26 which is fixedly connected to rib 27 due to the unitary construction of rib 27 and casing 26, this rupture occurring at a predetermined location on the casing corresponding to bore 50. It is further apparent that rupture 55 substantially removes the constraint of rib 27 on casing 31 thereby cooperating in the venting of explosive material 33 so as to prevent cook-off of the explosive material at its cook-off temperature.

Burster 11 includes a pair of washers 60, each washer being disposed at one end 51 of bore 50 in axial alignment therewith. Any suitable device, typified by a bolt and nut assembly 62, extends axially though the bore and the washers for tensioning to urge washers 60 into closing relation with rib 27 at each end of the bore and secure inert material 52 in an enclosure defined by washers 60 as well as by the interior of bore 50. Inert material 52 is thus in an enclosure separated from active material 33, these materials being further separated in the FIGS. 2 and 3 structure by warhead casing 31. Radially of bore 50, the inert and thermally expansive material 52 extends between assembly 62 and rib 27 and, axially of bore 52, material 52 extends between washers 60. Flow of material 52 from bore 50, at ambient temperature if material is not a solid as well as when the pressure of material 50 increases due to thermal expansion, may be prevented by any suitable sealing elements, such as a pair of washer-like seals 65 individually engaged at one side with washers 60 and, at the opposite side, provided with sealing lips 66 to engage the bolt of assembly 62 and the interior of bore 50.

To ensure that rib 27 ruptures at the region indicated by lines 55 and at the predetermined venting temperature, booster 11 has a stress riser which, typically, is a relatively small, sharp-edged groove 70 defined in rib 27. Groove 70 opens into bore 50 at the side thereof opposite from warhead 30 and extends axially of bore 50 between ends 51 but not thereto so as not to provide a path around seals 65. In the structure of burster 11 wherein rib 27 enclosing material 52 and exterior casing 26 are unitarily constructed, it is apparent that stress riser groove 70 may be considered to be disposed both in exterior casing 26 and in a wall formed by the rib about material 52.

SECOND EMBODIMENT

Figure 4:
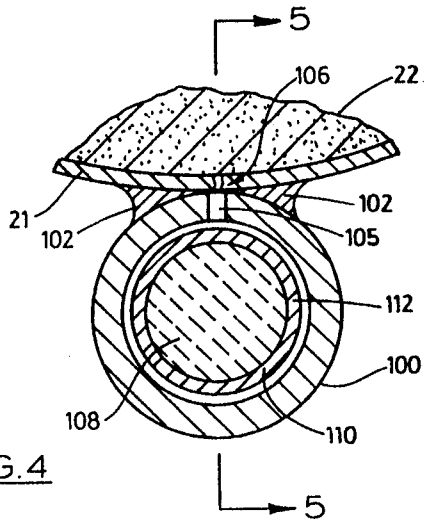
FIG. 4 is a diametrical section of a second embodiment of the invention from the position of line 4—4 of FIG. 1 and at an enlarged scale.

Burster 12, as shown in FIG. 1, is exteriorly disposed on rocket motor 20 at a predetermined location for direct subjection to heating as from a fire below the motor, and is shown in detail in FIGS. 4 and 5. Burster 12 includes an axially open-ended, cylindrically walled tube 100 fixed to rocket motor casing 21 by welds 102 shown in FIG. 4. Tube 100 has a stress riser 105, which is a slot disposed in and extending axially along the side of this wall toward casing 21. This slot functions similarly to groove 70 of FIGS. 2 and 3 to facilitate a rupture 106 through casing 21 to vent active propellant material 22 therein when sufficient force is exerted interiorly of tube 100 by any suitable and inert and thermally expansive material 108 which corresponds to material 52 of burster 11.

However unlike in burster 11, the thermally expansive material 108 of burster 12 is contained in a cylindrical capsule or container 110 which is itself enclosed in tube 100 and which has a cylindrical wall 112 extended coaxially through and thus enclosed by tube 100. Capsule wall 112 is constructed in any suitable manner making it relatively more ductile than tube 100. Capsule wall 112 may be provided with the necessary relative ductility by constructing the capsule of a material having a relatively low yield point and/or by making capsule wall 112 substantially thinner than tube 100. Capsule 110 has opposite closed axial ends 114 projecting oppositely from tube 100, each end terminating in a surface 116 extending transversely of the tube. Preferably, capsule 110 is unitarily constructed by forming one of the closed ends 114 by and swaging and then welding one end of a tube, inserting a selected quantity of the inert material in the tube, and then forming the other closed end 114 by swaging and welding. This construction is effective with a material 108 which is difficult to seal. Typically, the exterior diameter of capsule 110 is such that the capsule is slideably received within tube 100. Capsule 110 is retained axially in tube 100 in any suitable manner as by a pair of ears 118 shown in FIG. 5. Ears 118 are attached to tube 100, extend axially oppositely therefrom, and are bent radially centrally thereof so as to individually engage capsule end surfaces 116. It is evident the construction of burster 12 results in material 108 being secured within tube 100 and separated from the propellant material 22.

Figure 5:
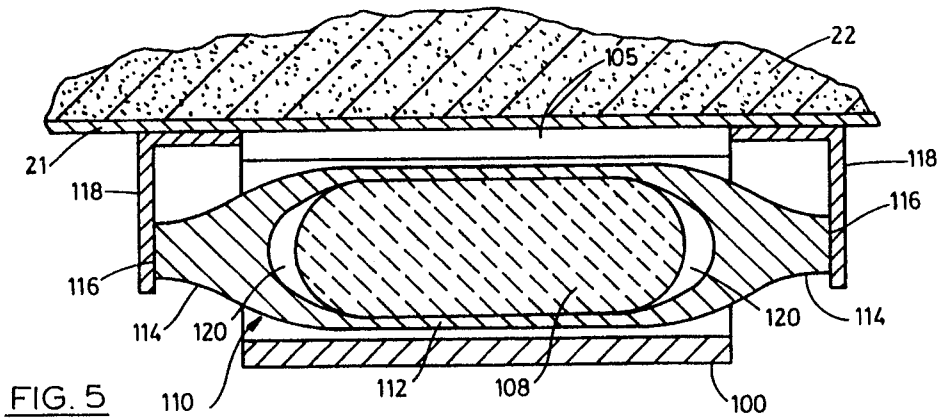
FIG. 5 is an axial section of the second embodiment from the position of line 5—5 of FIG. 4.

As shown in FIG. 5, the volume of the enclosure defined within tube 100 by the interior of capsule 110 is greater than the volume of the inert, thermally expansive material 108 at the usual ambient temperature. The balance of the capsule interior thus has at least one region 120 which is void of material 108 and typically contains air so that thermal expansion of this material is not significantly affected. As a result, material 108 exerts substantially no force on capsule 110 or tube 100 as the temperature of this material initially increases from such an ambient temperature until a predetermined pressurizing temperature is reached where the volume of material 108 is substantially equal to the interior volume of the capsule. This pressurizing temperature is between such an ambient temperature and a venting temperature at which continued expansion of material 108, as its temperature increases from the pressurizing temperature, exerts sufficient force interiorly of the capsule to cause rupture 106 due to the interior force within the capsule being transmitted by the ductile wall 112 thereof to the interior of tube 100. It is apparent that a desired venting temperature is selectable by choosing the volume of the void region or regions 120 relative to the volume of material 108 at ambient temperature so that pressurization of capsule 110, and thus exertion of rupturing force against tube 100, is delayed although the temperature of material 108 is increasing. It is also apparent that, since a force is not exerted against tube 100 by material 108 until it attains the pressurizing temperature, this temperature may be selected so that casing 21 is not weakened by burster 12 at expected operating temperatures which may be above the usual ambient temperatures.

Similar results may be obtained by making the exterior diameter of ductile capsule wall 112 somewhat smaller than the interior diameter of tube 100 at ambient temperature as shown in FIG. 5, these diameters being selected so that, as the temperature of burster 12 increases from the ambient temperature, no force is exerted on tube 100 by inert material 108 acting through ductile wall 112 until this material has expanded sufficiently to cause capsule 110 to centrally engage tube 100 at a predetermined pressurizing temperature which is between said ambient temperature and said venting temperature and at which the area of the exterior of capsule wall 112 is substantially equal to the area within tube 100.

THIRD EMBODIMENT

Figure 6:
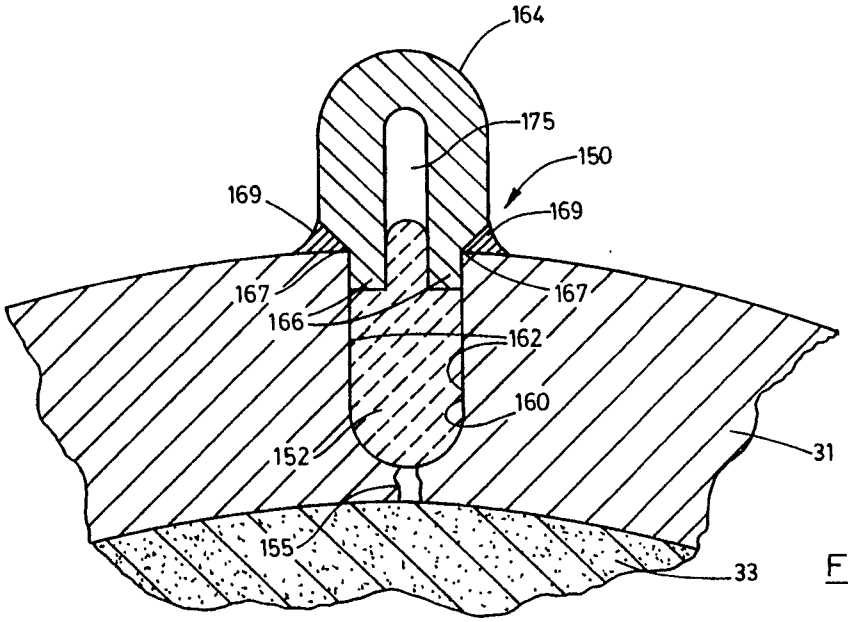
FIG. 6 is a transverse section of a third embodiment of the invention from the position of line 6—6 of FIG. 1 and at an enlarged scale.

Burster 13, as shown in FIGS. 1 and 6, is exteriorly disposed at a predetermined location on the relatively thick and strong casing 31 of penetrating warhead 30 and is within exterior warhead casing 26. As best shown in FIG. 6, burster 13 has an enclosure, indicated generally by numeral 150, for an inert material 152 which corresponds to material 52 of burster 11 and to material 108 of burster 12 and which expands thermally so as to cause rupture 155 in casing 31 for venting active explosive material 33 of the warhead at a predetermined venting temperature below the cook-off temperature of the active material.

Enclosure 150 is partially defined by a deep stress riser groove 160 extending radially inwardly into casing 31, as best shown in FIG. 6, and extending axially thereof, as shown in FIG. 1, so that groove 160 has a pair of opposite sides 162 extending axially along casing 31. Enclosure 150 is further defined by a member 164 which covers groove 160 and is U-shaped transversely thereof so that member 164 has opposite sides 166, this member also having opposite ends 168 spaced axially of casing 31 as shown in FIG. 1. Groove 160 and member 164 are aligned so that their interiors communicate and their corresponding opposite sides 162 and 166 engage. Sides 166 are configured, as by shoulders 167, so that these sides may enter somewhat into groove 160. Member 164 and casing 31 are fixedly connected by a weld 169 deposited exteriorly around member 164 where its sides 166 and ends 168 engage casing 31. As a result of the described construction used in burster 13, casing 31 is not significantly weakened for penetration purposes by burster 13. This construction, which allows casing 31 to be relatively strong, is advantageous where venting to prevent cook-off is to result from cooperation between stresses induced by a burster of the present invention and stresses due to pressurization of casing by beginning decomposition of explosive material 33. It is evident that, in this construction, member 164 defines a wall which encloses material 152, extends across groove 160, and is fixedly connected to casing 31 at the opposite sides of groove 160. It is also evident that this construction results in material 152 being secured within enclosure 150 and being separated from active explosive material 33.

As shown in FIG. 6 the volume of enclosure 150 is greater than the volume of the inert, thermally expansive material 152 at the usual ambient temperature. The balance of the capsule interior thus has a region 175 which is void of material 152. As a result and as with material 108 and region 120 of burster 12, material 152 exerts substantially no force on casing 31 or member 164 as the temperature of this material initially increases from such an ambient temperature until a predetermined pressurizing temperature is reached where the volume of material 152 is substantially equal to the volume of enclosure 150. Therefore, desired pressurizing and venting temperatures are selectable by choosing the volume of the void region 170 relative to the volume of material 152 at ambient temperature so that pressurization of enclosure 150 and any resulting weakening of casing 31 and venting of active material 33 at rupture 155 occurs at temperatures higher than the temperatures at which these effects would occur if the volumes of enclosure 150 and of inert, thermally expansive material 152 were equal at ambient temperature.

MATERIAL SELECTION AND OPERATING CONDITIONS

An inert, thermally activated burster embodying the present invention, such as a burster 11, 12, or 13, may be designed by stress calculations, which are believed well-known and need not be set forth herein, to rupture an associated ordnance device at a predetermined venting temperature. These calculations involve the volumetric thermal expansion coefficients of the inert expansion material, such as material 52, 108, or 152, and of the material, typically steel or aluminum, of the constraining enclosure typified by rib 27 with lightening bore 50 and by tube 100. These calculations also involve the bulk modulus of elasticity of these materials, the dimensions of the enclosure constraining the inert material, and the dimensions of the areas to be stressed by its thermal expansion. It is apparent that, in relation to the expansion material, the bulk modulus of the constraining material should be relatively high and its thermal expansion coefficient also high.

For purposes of the present invention where normal operating conditions for military ordnance devices have an upper limit of about 160° F. (71° C.) and where venting to prevent cook-off is typically to occur at about 300° F. (149° C.), the following described materials are believed effective as the inert, thermally expansive material 52, 108, or 152, "inert" for the purposes of the present invention meaning a material which will not detonate or deflagrate but which is not necessarily incombustible. Water may be effective although its bulk modulus and thermal expansion are relatively low. Glycerine has a relatively high bulk modulus and thermal expansion. Mercury has a relatively low thermal expansion but an extremely high bulk modulus. Finally, silicones, both elastomers and liquids, which have a relatively low bulk modulus but a very high thermal expansion coefficient, may be particularly effective in the practice of the present invention.

Obviously, many modifications and variations of the present invention are possible in light of the above teachings. It is, therefore, to be understood that the present invention may be practiced within the scope of the following claims other than as described herein.

What is claimed is:

1. An ordnance device comprising:

a casing;

a first material subject to cook-off when contained at a predetermined cook-off temperature, said first material being disposed within said casing;

a wall at least partially defining a rupturable enclosure, said wall being fixedly connected to said casing at a predetermined location thereon; and a quantity of an inert and thermally expansible second material disposed within said enclosure, said quantity having a predetermined volume when said quantity is at a predetermined ambient temperature substantially lower than said cook-off temperature, said volume being such that said quantity exerts on said wall a pressure insufficient to rupture said wall at said predetermined location, and expanding as the temperature of said quantity increases from said ambient temperature toward a predetermined venting temperature between said ambient temperature and said cook-off temperature so that said second material exerts on said wall at said venting temperature a force sufficient to rupture said wall and said casing and to vent said first material so as to prevent cook-off of said first material at said cook-off temperature.

2. The ordnance device of claim 1 wherein said casing has a stress riser at said predetermined location.

3. The ordnance device of claim 1 wherein said wall has a stress riser at said predetermined location.

4. The ordnance device of claim 1 wherein said enclosure has a predetermined enclosure volume greater than said predetermined volume of said quantity at said ambient temperature; said volume of said quantity being selected so that, as the temperature of said quantity increases from said ambient temperature, said quantity exerts substantially no force on said wall until the temperature of said quantity attains a predetermined pressurizing temperature which is between said ambient temperature and said venting temperature and at which the volume of said quantity is substantially equal to said enclosure volume.

5. A burster for rupturing a casing for an active material subject to cook-off, the burster rupturing the casing at predetermined venting temperature above a predetermined ambient temperature and comprising:

wall means fixedly connected to said casing for at least partially defining an enclosure separated from said active material;

means for defining a stress riser to promote a rupture extending from said enclosure through said wall means and said casing; and an inert material secured in said enclosure, said inert material being selected so as to exert on said wall means a force insufficient to initiate said rupture when said inert material is at said ambient temperature, tend to expand as the temperature of said inert material increases from said ambient temperature toward said venting temperature, and exert on said wall means a force causing said rupture when said inert material is at said venting temperature.

6. The burster of claim 5 wherein:

said casing includes a rib defining a bore having opposite ends, said wall means being a portion of said rib disposed circumferentially of said bore;

said burster further comprises a pair of closure elements, one of said elements being disposed at each of said ends, and tension means extending axially through said bore for urging said closure elements into closing relation with said rib at said ends of said bore;

said inert material is disposed radially of said bore between said tension means and said rib and is disposed axially of said bore between said closure elements; and said stress riser is a groove defined in said rib and opening into said bore.

7. The burster of claim 5 wherein:

said stress riser is a groove defined by said casing and having opposite sides; and said wall means extends across said groove and is fixedly connected to said casing at each of said opposite sides of said groove so that said enclosure includes said groove.

8. The burster of claim 5 further comprising a ductile container receiving said inert material and received in said enclosure.

9. The ordnance device of claim 7 wherein:

said enclosure has a predetermined enclosure area;

said container has an exterior container area, said exterior container area being disposed within said enclosure area and being less than said enclosure area at said ambient temperature; and said exterior container area is selected so that, as the temperature of said inert material increases from said ambient temperature, said inert material exerts substantially no force by way of said container on said enclosure until the temperature of said inert material attains a predetermined pressurizing temperature which is between said ambient temperature and said venting temperature and at which said exterior container area is substantially equal to said enclosure area.

* * * * *